US007131288B2

(12) United States Patent
Toonen et al.

(10) Patent No.: US 7,131,288 B2
(45) Date of Patent: Nov. 7, 2006

(54) HEAT EXCHANGER

(75) Inventors: Theodor Johannes Peter Toonen, Sambeek (NL); Peter Leerkamp, Boxmeer (NL); Bob Meuzelaar, Nijmegen (NL)

(73) Assignee: INCO Limited, Tononto (CA)

( * ) Notice: Subject to any disclaimer, the term of this patent is extended or adjusted under 35 U.S.C. 154(b) by 136 days.

(21) Appl. No.: 10/433,017

(22) PCT Filed: Nov. 23, 2001

(86) PCT No.: PCT/NL01/00853

§ 371 (c)(1),
(2), (4) Date: Dec. 29, 2003

(87) PCT Pub. No.: WO02/42707

PCT Pub. Date: May 30, 2002

(65) Prior Publication Data

US 2004/0226702 A1 Nov. 18, 2004

(30) Foreign Application Priority Data

Nov. 27, 2000 (NL) ..... 1016713

(51) Int. Cl.
*F25B 13/00* (2006.01)

(52) U.S. Cl. ..... 62/324.1; 165/146; 165/907

(58) Field of Classification Search ..... 62/324.1, 62/259.2; 165/146, 185, 80.2–80.5, 907
See application file for complete search history.

(56) References Cited

U.S. PATENT DOCUMENTS 4,108,241 A * 8/1978 Fortini et al. ..... 165/146
4,245,469 A 1/1981 Fortini et al.
4,303,125 A * 12/1981 Vahlbrauk ..... 165/168
4,378,397 A * 3/1983 Sussman ..... 428/215
5,246,064 A * 9/1993 Hoshino et al. ..... 165/146
5,303,771 A * 4/1994 Des Champs ..... 165/165
5,322,116 A * 6/1994 Galloway et al. ..... 165/133
5,437,328 A 8/1995 Simons
5,458,187 A * 10/1995 Davis ..... 165/54
5,673,561 A 10/1997 Moss
5,901,556 A 5/1999 Hofler
6,196,307 B1 * 3/2001 Ozmat ..... 165/185
6,379,833 B1 * 4/2002 Hill et al. ..... 429/34
6,411,508 B1 * 6/2002 Kang et al. ..... 361/695
6,634,419 B1 * 10/2003 Beldam et al. ..... 165/146

(Continued)

FOREIGN PATENT DOCUMENTS

DE 39 06 446 A 9/1990

(Continued)

OTHER PUBLICATIONS

Patent Abstracts of Japan, vol. 009, No. 114, May 18, 1995, JP 60 000294.

(Continued)

*Primary Examiner*—Mohammad M. Ali
(74) *Attorney, Agent, or Firm*—Thomas, Kayden, Horstemeyer & Risley, LLP; Todd Deveau

(57) ABSTRACT

In a heat exchanger (10) for transferring heat from a first fluid to a second fluid, which heat exchanger (10) comprises one or more flow passages (12) for a first fluid, the outer wall (26) of these passages is in heat-transferring contact with a flow body (20) made from metal foam for a second fluid. This metal foam has a gradient of the volume density of the metal, so that it is possible to achieve a favorable equilibrium between heat transfer and conduction, on the one hand, and flow resistance, on the other hand.

13 Claims, 5 Drawing Sheets

U.S. PATENT DOCUMENTS 6,840,307 B1 * 1/2005 Eesley et al. ..... 165/80.3

FOREIGN PATENT DOCUMENTS

| | | | |
|---|---|---|---|
| DE | 44 01 24 6 | A | 7/1995 |
| DE | 298 14 078 | U | 11/1998 |
| EP | 0 460 392 | A | 12/1991 |
| FR | 2 429 988 | | 1/1980 |
| FR | 2 766 967 | | 2/1999 |
| WO | WO 95/23951 | A | 9/1995 |

OTHER PUBLICATIONS

Patent Abstracts of Japan, vol. 009, No. 330, Dec. 25, 1985, JP 60 162195.

* cited by examiner

HEAT EXCHANGER

RELATED APPLICATION

This application claims priority to and the benefit of NL1016713 filed Nov. 27, 2000.

FIELD OF THE INVENTION

The invention relates to a heat exchanger for transferring heat from a first fluid to a second fluid, comprising one or more flow passages for a first fluid, which are arranged parallel to and at a distance from one another and the outer wall of which is in heat-transferring contact with a flow body for a second fluid, which is made from metal foam.

BACKGROUND OF THE ART

EP-A-0 744 586 has disclosed a heat-transfer element, for example a plate or tube, with a large heat-transferring surface in the form of copper foam, for use in a heat exchanger, in order to improve the heat transfer. An element of this type is produced by using a vapour deposition process to deposit a powder of copper oxide on a plastic foam which has previously been provided with a suitable adhesive. The foam which has been prepared in this way is then arranged under slight pressure on a plate or tube, which has likewise previously been covered with a copper oxide powder, in order in this way to form a composite element by sintering. After pyrolysis of the plastic foam, the copper oxide is reduced to form copper.

A heat exchanger of the type described above is used, for example, in what are known as thermo-acoustic heat engines. In a heat exchanger of this type, a first heat circuit is formed by a flow of a first fluid, such as a gas or liquid, through generally a plurality of flow passages. A second heat circuit comprises a flow of a second fluid, generally a gas (air, argon), through the porous flow body, which flow body surrounds the flow passages over a certain area. The direction of flow of the second fluid through the flow body is generally virtually perpendicular to the direction of flow of the first fluid in the flow passages. The porous flow body is in heat-exchanging contact with the outer wall of the flow passages. Heat is transferred, for example, from the first fluid to the inner wall of the flow passages and is carried to the outer wall as a result of conduction in the wall material. At the outer wall, heat transfer to the porous flow body takes place through radiation and conduction. Heat conduction takes place in the porous flow body. When there is only a flow body made from metal foam, this heat conduction is limited, and consequently solid lamellae made from a material with good conductivity are sometimes provided in the metal foam in order to increase the heat conduction. Transfer of heat from the flow body to the second fluid likewise takes place by means of radiation and conduction. The efficiency of the heat transfer overall is dependent, inter alia, on all these transitions, the transfer from the flow body to the second fluid or vice versa—generally the heat transfer on the gas side—in particular possibly representing an inhibiting factor.

It has now been found that, although the use of a metal foam, optionally in combination with lamellae or fins, offers an enlarged heat-exchanging surface area and possibly increased conduction, the flow resistance is relatively high, so that the overall performance, expressed as the ratio between heat transfer and flow resistance, is inferior to that of a conventional heat exchanger with only fins or lamellae.

In many cases, an increase in the heat transfer when using a metal foam goes hand-in-hand with a disproportionate increase in the flow resistance.

U.S. Pat. No. 4,245,469 has disclosed a heat exchanger in which a porous metal matrix is arranged in a flow passage through which a heat-transferring medium flows. It is stated that this metal matrix has a greater density in an area which is perpendicular to the direction of flow, so that the internal heat transfer coefficient is increased in this area, where the temperature of the environment is much higher than at the end of the passage. To minimize the reduction in volume of the heat-transfer medium which would be produced with a passage of constant diameter, the diameter is increased at the location of the said area. A design of this type aims to improve the internal heat transfer.

Furthermore, DE A1 39 06 446 has disclosed a heat exchanger in which a foam, for example of aluminium, is arranged in a flow passage. If desired, the pore size in this foam may be varied, i.e. the number of pores may vary.

SUMMARY OF THE INVENTION

The general object of the invention is to improve the overall performance, i.e. the abovementioned relationship between heat transfer and flow resistance, of a heat exchanger.

In the heat exchanger of the type described above, according to the invention the metal foam has a gradient of the volume density of the metal. The use of a metal foam with a gradient of the volume density enables the volume density of the foam, in other words the amount of metal, to be adapted to the local heat flux density and flow resistance, while the number of pores (PPI) remains the same. In the metal foam, the heat flux density is highest in the vicinity of the flow passages, so that the metal foam should contain more metal at this location than at the outer periphery of the flow body, where the heat flux density is much lower. This is possible as a result of the volume density of the metal of the metal foam used being varied. The arrangement of the metal foam in the heat exchanger according to the invention has the object of promoting the heat transfer from the metal foam to the wall of the flow passage. A volume gradient of the metal in the metal foam while the PPI remains identical is more effective than varying the number of pores while the thickness of the metal webs which separate the pores remains the same.

Metal foam with a gradient of the volume density of this type can be obtained, for example, by electroplating methods for the electroplating of a plastic foam in an electrolysis bath, as will be explained in more detail below.

It should be noted that FR-A-2 766 967 has disclosed a heat sink, inter alia for electronic components, which comprises a metal foam with a gradient of the thickness of the deposited metal in the thickness direction of the foam.

Since in a production method of this type the density in the foam changes in one direction, the flow body preferably comprises at least two layers of metal foam, of which layer surfaces which have the same volume density face towards one another. This allows various advantageous embodiments of the flow body to be achieved.

In a first preferred embodiment, the volume density of the metal foam increases from an inflow side of the flow body for the second fluid towards a flow passage, so that more metal is present where the heat flux density is greater.

The shape of the flow passages is not critical; round tubes, flat hollow plates and the like can be used. However, to limit the flow resistance, the shape of a flow passage is preferably adapted to the flow profile of the second fluid. A flow passage advantageously has an elliptical cross section, the main axis of which extends in the direction of flow of the second fluid. A flow passage of such a shape combines a large heat-exchanging surface area with a relatively low flow resistance.

The flow body then advantageously comprises two layers of metal foam, preferably having the same number of pores per linear inch (PPI), of which the sides with the highest metal volume density face towards one another. In those sides, recesses for the flow passages are provided.

According to another preferred embodiment, which is advantageous in particular on account of the simple modular structure, the flow passages comprise tubular bodies which are rectangular in cross section and are separated by sections of the flow body, the volume density of the sections of the flow body being highest in the vicinity of the outer walls of the flow passages. A module of this preferred embodiment of a heat exchanger may comprise, for example, a flow passage of this type which is rectangular in cross section and of which two opposite walls are provided with a layer of metal foam, of which the layer surface with the highest volume density adjoins the walls in question.

If a heat exchanger which more closely resembles a heat exchanger with a flow body comprising metal foam parts separated by lamellae is desired, it is possible to use a plurality of layers of metal foam, of which the gradients of the volume density run parallel to the direction of flow of the first fluid, preferably alternately. In terms of overall performance, this embodiment is less preferred than the other variants described above.

If a metal foam is selected as material for the porous flow body, the heat transfer between metal foam, on the one hand, and the second fluid, on the other hand, is high and no longer the limiting factor, on account of the very large heat-exchanging surface area for a given volume.

The heat conduction in the flow body made from metal foam, however, is low, on account of the porosity thereof, which porosity also has an adverse effect on the heat transfer between the flow body and the outer wall of the flow passages. A gradual increase in the quantity of metal in the foam leads to an improvement in the overall effect of these two contradictory factors.

It is preferable to use a metal foam made from a metal with a high heat conduction coefficient, such as copper. The flow bodies are advantageously also made from a metal with high heat conduction and heat transfer, such as copper. Other suitable metals include, inter alia, indium, silver, nickel and stainless steel. The starting material used for the production of the metal foam is advantageously a plastic foam, such as polyurethane, polyester or polyether with an open network of interconnected pores and a constant PPI value. The diameter of the pores is preferably in the range from 400–1500 micrometers, more preferably 800–1200 micrometers. The volume gradient may rise from less than 5% to more than 95% in the direction of flow of the fluid flowing through the foam. The thickness of the metal deposited on the plastic foam advantageously has a gradient which ranges from 5–10 micrometers, preferably at the inflow side of the flow body, to 30–70 micrometers, preferably in the vicinity of the flow passages, for example 8 micrometers and 42 micrometers, respectively. Metal foams of this type are easy to produce by means of electroforming of, for example, copper on a substrate of polymer foam in a suitable electrolysis bath, optionally followed by pyrolysis of the polymer. If desired, a thin conductive layer, for example a copper layer, may first be deposited on the foam using other techniques, for example (magnetron) PVD, CVD and the like, after which this film is allowed to grow further in the electrolysis bath.

Various welding techniques (induction, diffusion) and soldering techniques can be used to attach the metal foam to the flow passages. Tin-containing soldering alloys are eminently suitable for copper foam.

The heat exchanger according to the invention is preferably of modular structure, so that a plurality of modules can be combined to form a larger unit.

The invention also relates to a heat pump, for example a thermo-acoustic conversion device, for converting energy as defined in claim 11, in which heat exchangers according to the invention are used. The motor for compressing and displacing the gaseous fluid is, for example, a closed acoustic resonance circuit. The regenerator used preferably has a layered structure comprising foam layers of a metal with poor conductivity. Examples of a thermo-acoustic conversion device of this type include a thermo-acoustic heat engine and a thermo-acoustic motor.

BRIEF DESCRIPTION OF THE DRAWINGS

The invention will be explained below with reference to the appended drawing, in which.

DETAILED DESCRIPTION OF THE DRAWINGS

Figure 1:
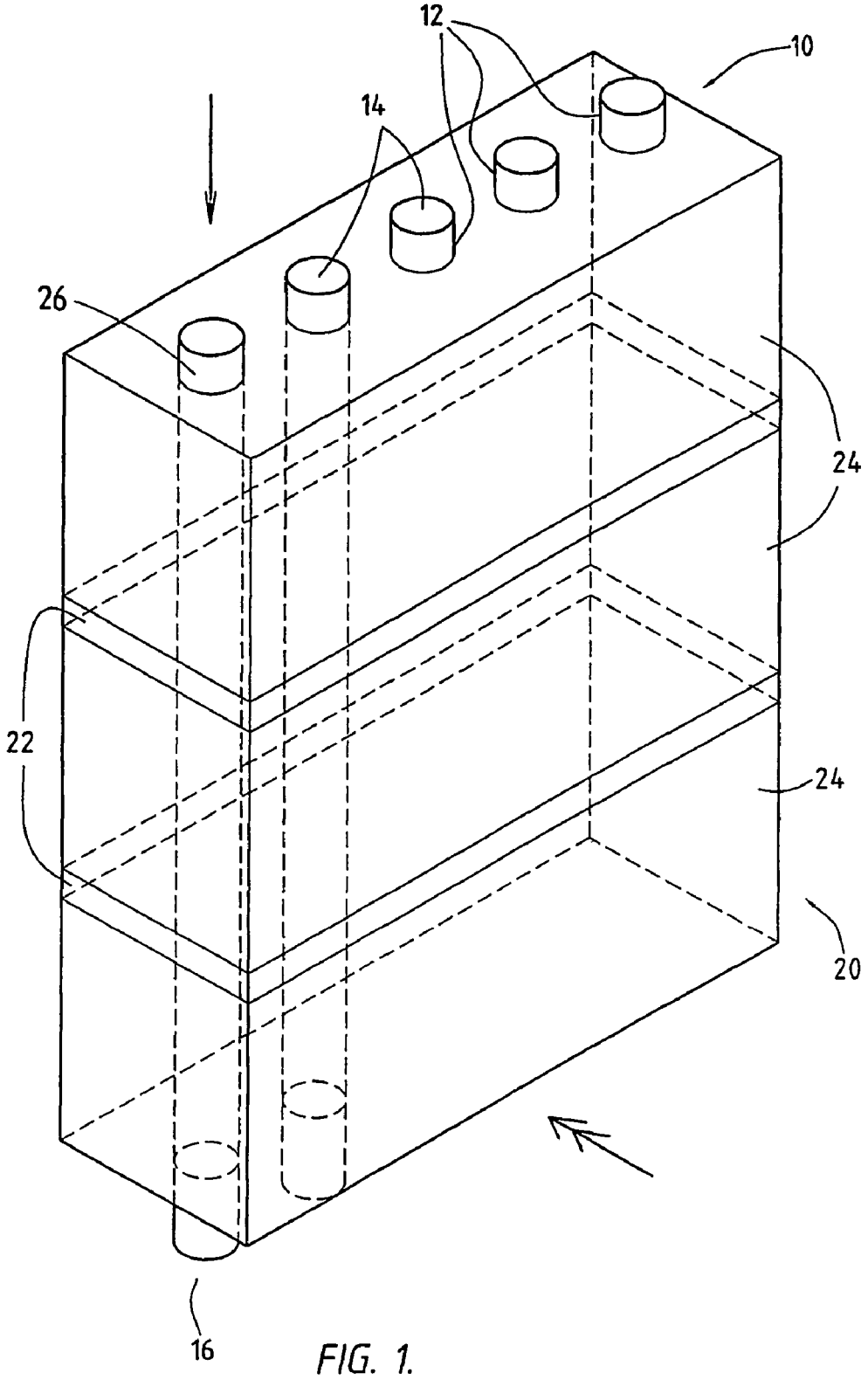
FIG. 1 shows a perspective view of an embodiment of a heat exchanger according to the prior art.

In the embodiment of a heat exchanger 10 according to the prior art which is illustrated in FIG. 1, a number of tubular flow passages 12, for example made from copper, are arranged parallel to one another. The direction of flow of a first fluid through the flow passages 12 is indicated by a single arrow, in the situation illustrated from the top downwards. The inlet ends 14 of the flow passages 12 are usually connected to one another with the aid of a distributor cap (not shown). The outlet ends 16 are connected to one another in a similar way. A porous flow body for a second fluid is denoted overall by reference numeral 20 and comprises a number of metal strips 22 which are arranged at a distance from and parallel to one another and each have a layer 24 of metal foam between them. Holes for the flow passages 12 are provided at the appropriate locations in the metal strips 22 and layers 24. The metal strips 22 are soldered to the outer walls 26 of the flow passages 12. The flow body 20 is arranged in a chamber or housing (not shown), which are provided with a feed and a discharge and, if desired, distributor means for the second fluid. The sides of the housing of the heat exchanger 10 may be provided with coupling means, so that a plurality of heat exchangers can be coupled to one another as required.

Figure 2:
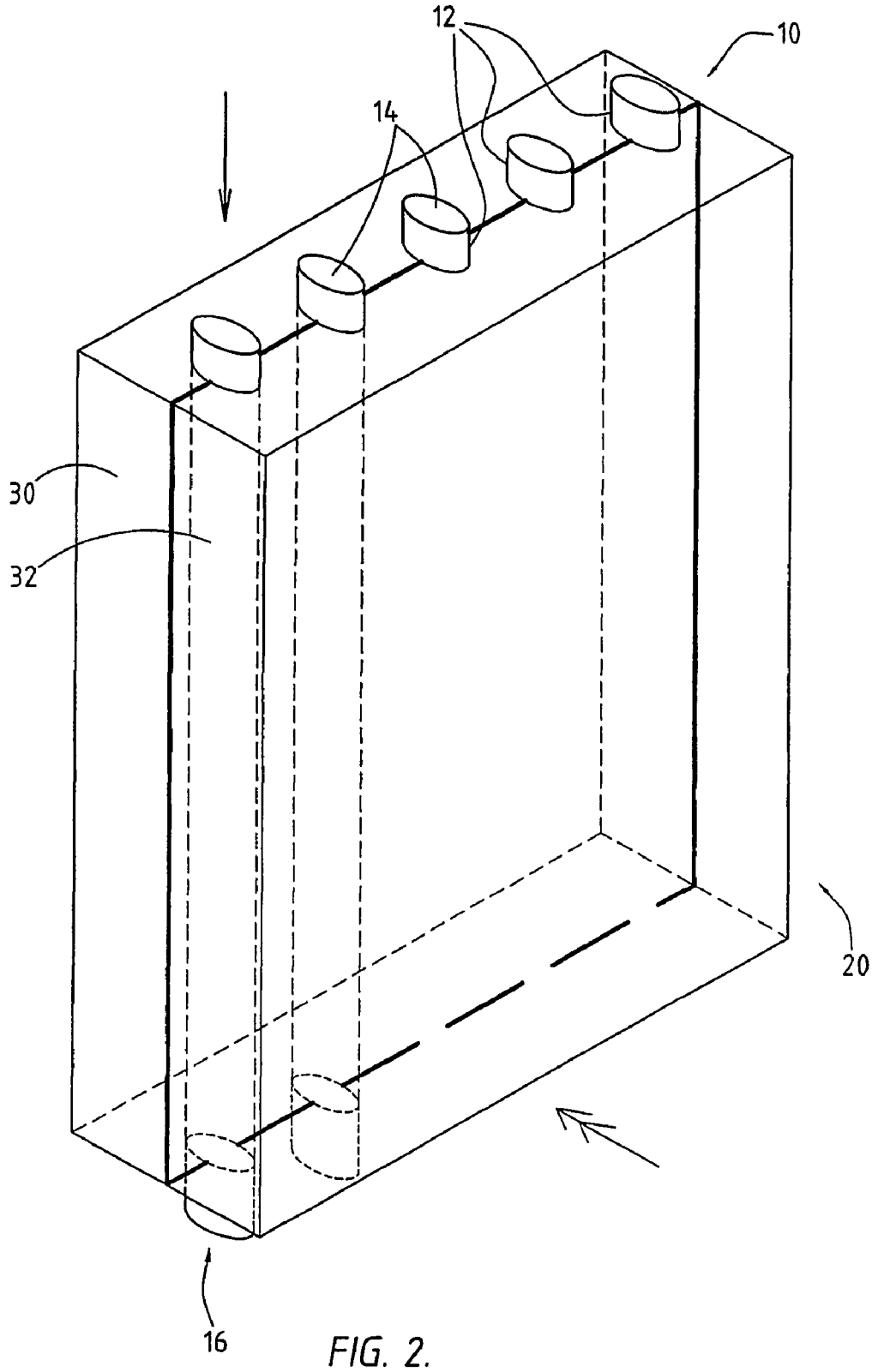
FIG. 2 shows a perspective view of a first embodiment of a heat exchanger according to the invention.

FIG. 2 shows a preferred embodiment of a heat exchanger according to the invention, in which identical components to those shown in FIG. 1 are denoted by the same numbers and references.

The heat exchanger 10 comprises a number of parallel flow passages 12 which are arranged at a distance from one another and have an elliptical cross section, through which a first fluid, for example a liquid, is guided. The flow body 20 comprises two metal foam parts 30 and 32, each with a gradient of the volume density parallel to the direction of flow of the second fluid, for example a gas. To simplify the figure, the surface with the highest volume density is indicated by a thick solid line in this figure and the following figures. In part 30, the volume density (amount of metal) increases in the direction of flow of the second fluid, while in part 32 the volume density decreases in the direction of flow indicated. Consequently, most metal is present in the immediate vicinity of the flow passages 12, where the highest heat flux density also prevails. The outer surface of the flow body 20, in particular the inflow side (and discharge side), is relatively open.

Figure 4:
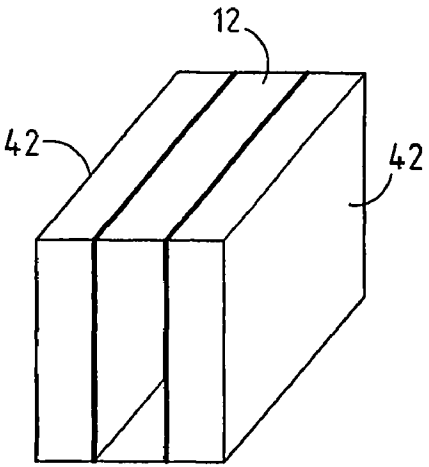
FIG. 4 shows a perspective view of a module of the heat exchanger according to claim 3.
Figure 3:
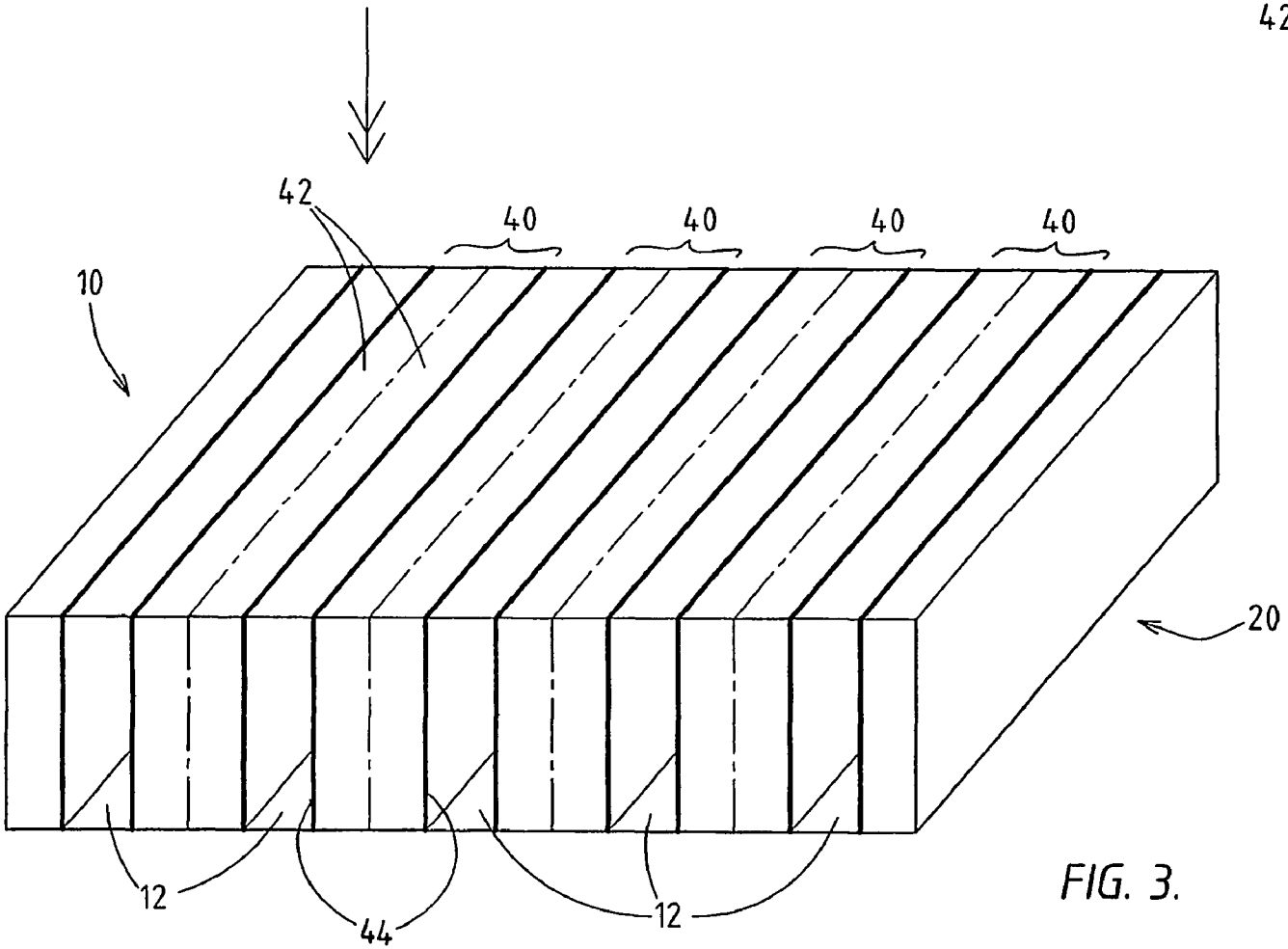
FIG. 3 shows a perspective view of a second embodiment of a heat exchanger according to the invention.

FIG. 3 shows another embodiment, in which flow passages 12 which are rectangular in cross section are arranged between sections 40 of the flow body 20. Each section 40 is composed of two metal foam layers 42, whose surfaces with the highest volume density adjoin the outer walls 44 of two flow passages 12 arranged next to one another, while the surfaces having the lowest volume density bear against one another. In this figure, the separating surface between the two foam layers 42 of a section 40 are indicated by a dot-dashed line. FIG. 4 shows a module of the embodiment of a heat exchanger according to the invention illustrated in FIG. 3.

Figure 5:
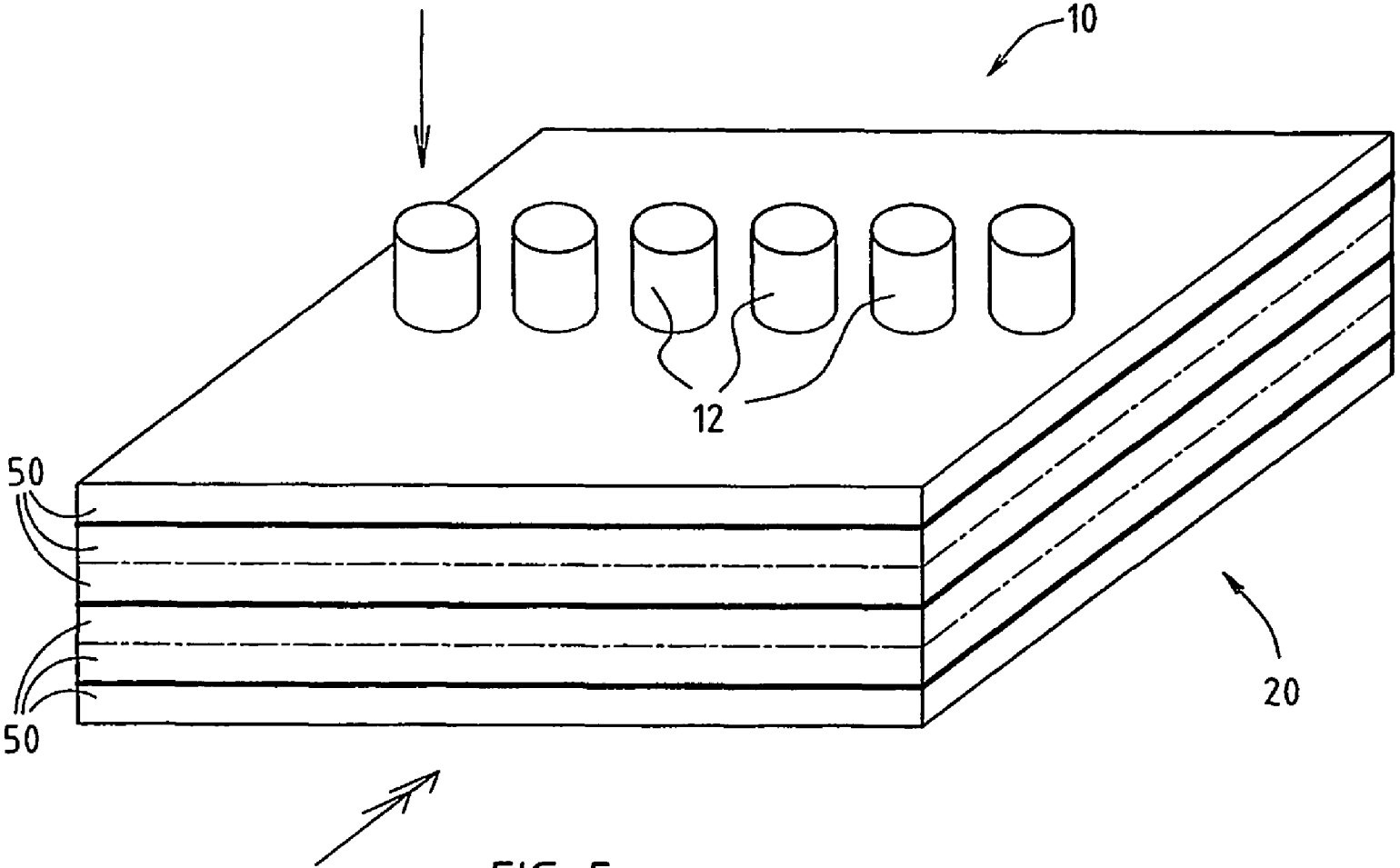
FIG. 5 shows a perspective view of a third embodiment of a heat exchanger according to the invention.

FIG. 5 shows yet another variant of a heat exchanger according to the invention, in which six alternately stacked metal foam layers 50 are provided as flow body 20, the gradient of which alternately increases and decreases repeatedly as seen in the direction of flow of the first fluid which is guided through the flow passages 12.

Figure 6:
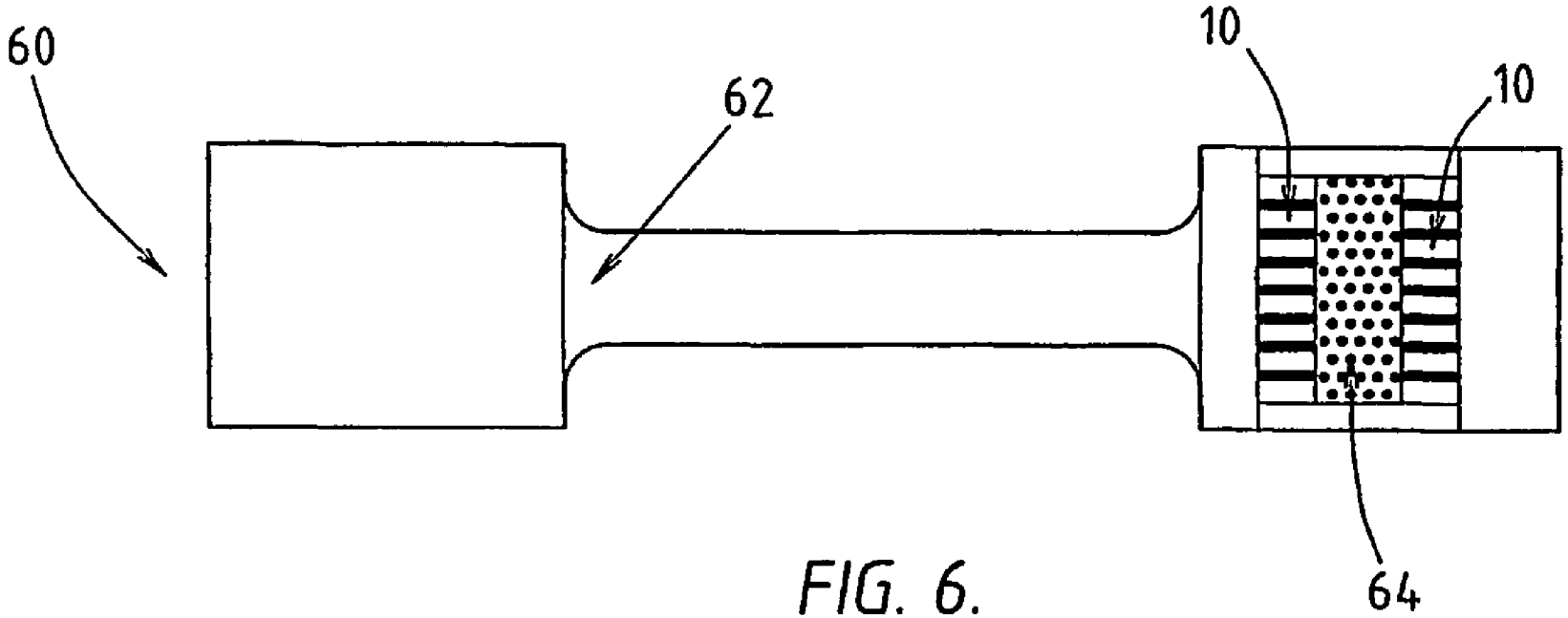
FIG. 6 diagrammatically depicts a thermo-acoustic conversion device for energy conversion, in which heat exchangers according to the invention are used.

FIG. 6 shows an outline sketch of a heat pump according to the invention, in this case an embodiment of a thermoacoustic conversion device 60 for energy conversion, in which heat exchangers according to the invention can advantageously be used.

The device 60 comprises a gas-filled acoustic or acoustomechanical resonance circuit 62 with a regenerator 64, for example made from nickel foam, arranged between two heat exchangers 10 according to the invention. If the device 60 is used as a heat pump, mechanical energy is supplied to the gas, for example via a diaphragm which is made to oscillate with the aid of a linear electric motor. Other possibilities include, for example, a bellows or a free piston structure. The gas which has been made to oscillate and functions as a second fluid extracts heat from a first fluid in the first heat exchanger 10 and pumps the extracted heat via the regenerator to the second heat exchanger 10, where the heat is transferred to a third fluid. In this way, it is possible to transfer heat from a flow of fluid which is at a low temperature to a fluid which is at a high temperature. The periodic pressure variation and gas displacement required for this process takes place in the closed resonance circuit 62 under the influence of a powerful acoustic wave. At this point, it should be noted that the pressure amplitude is many times greater than is customary in a free space, namely of the order of magnitude of 10% of the mean pressure in the system.

If the conversion device is used as a motor, heat is supplied to a heat exchanger at high temperature and is dissipated by a further heat exchanger at low temperature, for example ambient temperature, with the result that the oscillation is maintained if more heat is supplied than is necessary to maintain the oscillation, it is possible for some of the acoustic energy to be extracted from the resonator as useful output.

The performance of the heat exchangers according to the invention is explained in more detail below on the basis of the following examples.

Various heat exchangers were produced and tested. The porous flow body of a first heat exchanger A is made from strips of copper foam (65 pores per inch) with a length of 90 mm and a width of 12 mm. Holes are stamped out for the flow passages. The flow passages comprised nine small copper tubes, with an external diameter of 6 mm (internal diameter 4 mm) arranged at regular intervals. The effective passage for the second fluid is 90 mm×70 mm. Manifolds at the inlet ends and outlet ends of the small copper tubes were connected to a water feed and a water discharge, respectively.

In a second heat exchanger B, a flow body made from the same copper foam is used, but brass lamellae with a thickness of 0.25 mm are fitted in this heat exchanger. The foam and the lamellae are soldered together in a furnace. To prevent the metal foam from closing up under the influence of heat, the strips of copper foam and brass lamellae can also be soldered one by one to the small copper tubes.

In a third heat exchanger C, the flow body only comprises 39 brass lamellae.

In a fourth heat exchanger D according to the invention, as shown in FIG. 2, having the same dimensions and number of tubes as heat exchangers A–C, the flow body comprises two layers of copper foam, which were produced at room temperature on a PU foam with a pore diameter of 800 micrometers in a copper bath of composition $CuSO_4$=250 g/l, $H_2SO_4$=70 g/l, $Cl^-$=15 mg/l and pH=0–1, at a current density of 5 A/dm$^2$. After pyrolysis, a copper foam layer produced in this way had a metal thickness of 8 micrometers on one side, while on the other side the thickness of the deposited metal was 42 micrometers. Recesses corresponding to half the diameter of the small copper tubes were provided in the latter sides of these foam layers, after which the small tubes were positioned in these recesses. Tin soldering was used as the joining technique.

These heat exchangers were used to carry out tests, in which a quantity of hot water (T=approx. 80° C.) controlled using a flowmeter was circulated through the small tubes via a thermostat bath. A centrifugal pump was used to suck ambient air through the flow body of the heat exchanger, which was arranged in a passage. The volume of air sucked in was measured using a flowmeter between the heat exchanger and the centrifugal pump. The pressure drop across the flow body and the inlet temperature $T_1$ and outlet temperature $T_2$ of the first flow of fluid, comprising water, and the outlet temperature $T_3$ of the second flow of fluid, comprising air, were measured. The quantity of heat Q absorbed by the flow of air is calculated from the volumetric flow rate of water $F_W$ (1/min) and the temperature difference between the incoming and outgoing flow of water ($T_1$–$T_2$) using the following formula:

$$Q=W_W\cdot(T_1-T_2).F_W/60\ [W],$$

where $W_W$ is the heat capacity of water (4180 J.Kg.K$^{-1}$). The tests were carried out at various air velocities. The Reynolds number was determined from the measured gas velocity at the location of the heat exchanger and the hydraulic diameter $D_H$=0.0033 for all the heat exchangers A–D. The viscosity value applies at the gas temperature of the fresh air sucked in, which temperature was likewise measured. The Nusselt number for the gas side can be calculated by eliminating the heat transfer on the liquid side and assuming turbulent tube flow: $Nu(Re)=Q.D_H/\lambda.\Delta T_1$, where $A_W$ is the total heat exchange surface area and $\Delta T_1$ is the temperature difference between gas and heat exchanger.

As is customary in the specialist field, the heat transfer is represented as $jH=Nu.\ Re^{-1}.\ Pr^{-1/3}$ against Re, where Pr is the Prandtl number, which for air is 0.7.

The so-called friction coefficient can be calculated in the same way $$f=A_0\Delta p/A_W(\tfrac{1}{2}\rho v^2)$$

from the measured pressure drop and the measured velocity for these heat exchangers of known dimensions and can be represented as a function of the Reynolds number.

The table below shows the results of the heat transfer (jH), the friction coefficient (f) and the ratio jH/f for Re=300 for the various heat exchangers A–D.

TABLE

| Heat exchanger | jH | f | jH/f |
|---|---|---|---|
| A | 0.07 | 20 | 0.004 |
| B | 0.7 | 40 | 0.018 |
| C | 0.03 | 1.4 | 0.021 |
| D | 0.5 | 15 | 0.033 |

It can be seen from the above table that, as expected, heat exchanger A (foam alone) provides a higher heat transfer than heat exchanger C (lamellae alone). However, the flow resistance has increased disproportionately. Furthermore, it can be seen that, although heat exchanger B (foam and lamellae) achieves a higher heat transfer than heat exchanger D according to the invention, the flow resistance is very high. The heat exchanger according to the invention has the best overall performance, expressed as jH/f. It is clear from this that, by using a foam with a suitable distribution of metal and by changing the amount of this metal, it is possible to achieve a favorable balance between heat transfer/conduction, on the one hand, and flow resistance, on the other hand.

The invention claimed is:

1. Heat exchanger for transferring heat from a first fluid to a second fluid, comprising one or more flow passages for a first fluid, which are arranged parallel to and at a distance from one another and the outer wall of which is in heat-transferring contact with a flow body for a second fluid, which is made from metal foam, wherein the metal foam has a constant number of pores (PPI) and has a gradient of volume density.

2. Heat exchanger according to claim 1, wherein the flow body is composed of two layers of metal foam, of which layer surfaces with the same volume density face towards one another.

3. Heat exchanger according to claim 1, wherein the volume density of the metal foam increases from an inflow side of the flow body for the second fluid towards the flow passages.

4. Heat exchanger according to claim 1, wherein the flow passages have an elliptical cross section, the main axis of which extends in the direction of flow of the second fluid.

5. Heat exchanger according to claim 1, wherein the flow passages comprise tubular bodies which are rectangular in cross section and are separated by sections of the flow body, the volume density of the sections of the flow body being highest in the vicinity of the outer walls of the flow passages.

6. Heat exchanger according to claim 2, wherein the gradient alternately increases and decreases in the direction of flow of the first fluid.

7. Heat exchanger according to claim 1, wherein the metal of the metal foam is copper.

8. Heat exchanger according to claim 1, wherein the connection between the flow body and the outer wall of the at least one flow passage comprises a soldered joint.

9. Heat exchanger according to claim 8, wherein the soldered joint comprises tin or a tin alloy.

10. Heat exchanger according to claim 1, wherein the heat exchanger has a modular structure and is provided with coupling means for coupling modular heat exchangers to one another.

11. Heat pump for energy conversion, comprising a motor for compressing and displacing a gaseous second fluid, and a heat exchanger for transferring heat from a first fluid to the second fluid, and a heat exchanger for transferring heat from the second fluid to a third fluid, a regenerator being arranged between the beat exchangers, as seen in the direction of flow of the gas, wherein the heat exchangers comprise one or more flow passages for a first fluid, which are arranged parallel to and at a distance from one another and the outer wall of which is in heat-transferring contact with a flow body for a second fluid, which is made from metal foam, wherein the metal foam has a constant number of pores (PPI) has a gradient of volume density.

12. Heat pump according to claim 11, wherein the regenerator comprises a layered structure of a plurality of layers of metal foam made from a metal with poor conductivity.

13. Heat pump according to claim 12, wherein the metal of poor conductivity is nickel.

* * * * *